US009131817B2

(12) United States Patent
Huang et al.

(10) Patent No.: US 9,131,817 B2
(45) Date of Patent: Sep. 15, 2015

(54) INTELLIGENT VACUUM CLEANER

(71) Applicant: Shenzhen Silver Star Intelligent Technology CO., LTD., Shenzhen, Guangdong (CN)

(72) Inventors: Ming Huang, Shenzhen (CN); Yongyi Shi, Shenzhen (CN)

(73) Assignee: Shenzhen Silver Star Intelligent Technology Co., Ltd., Shenzhen, Guangdong (CN)

( * ) Notice: Subject to any disclaimer, the term of this patent is extended or adjusted under 35 U.S.C. 154(b) by 392 days.

(21) Appl. No.: 13/717,719

(22) Filed: Dec. 18, 2012

(65) Prior Publication Data

US 2014/0013539 A1 Jan. 16, 2014

(30) Foreign Application Priority Data

Jul. 10, 2012 (CN) ..... 2012 1 0236453

(51) Int. Cl.
*A47L 9/00* (2006.01)

(52) U.S. Cl.
CPC . *A47L 9/00* (2013.01); *A47L 9/009* (2013.01); *A47L 2201/00* (2013.01); *A47L 2201/04* (2013.01)

(58) Field of Classification Search
CPC ..... A47L 9/00; A47L 9/08
USPC ..... 15/412, 323
See application file for complete search history.

(56) References Cited

U.S. PATENT DOCUMENTS

| | | | | |
|---|---|---|---|---|
| 8,584,305 | B2 * | 11/2013 | Won et al. | 15/319 |
| 2008/0276408 | A1 * | 11/2008 | Gilbert et al. | 15/320 |
| 2008/0302586 | A1 * | 12/2008 | Yan | 180/24.08 |
| 2010/0037421 | A1 * | 2/2010 | Haan | 15/383 |
| 2012/0311810 | A1 * | 12/2012 | Gilbert et al. | 15/320 |

* cited by examiner

*Primary Examiner* — Dung Van Nguyen
(74) *Attorney, Agent, or Firm* — Raymond Y. Chan; David and Raymond Patent Firm

(57) ABSTRACT

An intelligent vacuum cleaner includes a main casing, a vacuum cleaning arrangement, and at least one detachable wheel assembly arrangement. The main casing has a plurality of wheel compartments formed at a bottom side of the main casing. The vacuum cleaning arrangement is operatively provided in the main casing for generating a predetermined vacuum effect. The detachable wheel assembly arrangement is provided on the bottom side of the main casing, and includes at least one driving wheel and a detachable mechanism which is connected to the driving wheel and is detachably mounted in the main casing so that the diving wheel and the detachable mechanism are selectively detachable from the main casing for convenient cleaning of the bottom side of the main casing.

19 Claims, 7 Drawing Sheets

INTELLIGENT VACUUM CLEANER

BACKGROUND OF THE PRESENT INVENTION

1. Field of Invention

The present invention relates to a vacuum cleaner, and more particularly to an intelligent vacuum cleaner comprising a detachable wheel assembly arrangement in which a driving wheel is selectively detachable from a main casing through a detachable mechanism wheel so that a user is able to conveniently detach the driving wheel and clean a bottom side of the main casing.

2. Description of Related Arts

Referring to FIG. 1 to FIG. 2 of the drawings, a conventional intelligent vacuum cleaner usually comprises a main unit 1 and a plurality of driving wheel assemblies provided on a bottom side of the main unit 1 for driving the intelligent vacuum cleaner to move on a ground surface. The main unit 1 usually has a plurality of driving cavities formed on the bottom side of the main unit 1, a plurality of wheel cavities also formed on the bottom side of the main unit 1 and communicated to the corresponding driving cavity, while each of the driving wheel assemblies usually comprises a wheel cover 4 provided on the main unit 1 for selectively covering the corresponding driving cavity. Each of the driving wheel assemblies comprises a driving mechanism received in the corresponding driving cavity, and a driving wheel connected to the corresponding driving mechanism and is rotatably mounted in the corresponding wheel cavity.

The disadvantage of the above-mentioned intelligent vacuum cleaner is that the wheel cover 4 is usually connected to the main unit 1 through complicated mechanical connectors. For example, the wheel cover 4 may be connected to the main unit 1 through screws. In this situation, when a user wishes to access the driving cavity, he or she has to utilize some sorts of hand tools for opening the driving cavity. This imparts great inconvenience to users of conventional intelligent vacuum cleaner.

SUMMARY OF THE PRESENT INVENTION

The invention is advantageous in that it provides an intelligent vacuum cleaner comprising a detachable wheel assembly arrangement in which a driving wheel is selectively detachable from a main casing through a detachable mechanism wheel so that a user is able to conveniently detach the driving wheel and clean a bottom side of the main casing.

Another advantage of the invention is to provide an intelligent vacuum cleaner comprising a detachable wheel assembly arrangement wherein the driving wheel can be selectively detached from the main casing without using any hand tool.

Another advantage of the invention is to provide an intelligent vacuum cleaner comprising a detachable wheel assembly arrangement Another advantage of the invention is to provide an intelligent vacuum cleaner comprising a detachable wheel assembly arrangement which does not involve complicated mechanical or electrical components.

Additional advantages and features of the invention will become apparent from the description which follows, and may be realized by means of the instrumentalities and combinations particular point out in the appended claims.

According to the present invention, the foregoing and other objects and advantages are attained by providing an intelligent vacuum cleaner, comprising:

a main casing having a plurality of wheel compartments formed at a bottom side of the main casing;

a vacuum cleaning arrangement operatively provided in the main casing for generating a predetermined vacuum effect; and at least one detachable wheel assembly arrangement which is provided on the bottom side of the main casing, and comprises at least one driving wheel and a detachable mechanism which is connected to the driving wheel and is detachably mounted in the main casing so that the diving wheel and the detachable mechanism are selectively detachable from the main casing for convenient cleaning of the bottom side of the main casing.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
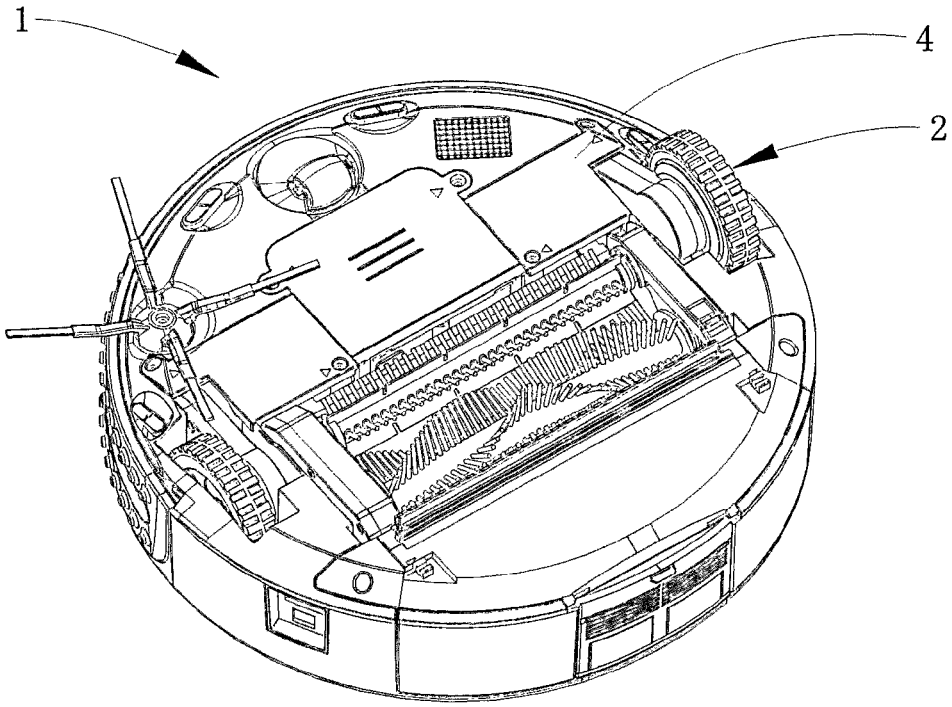
FIG. 1 PRIOR ART
FIG. 1 is a perspective view of a conventional intelligent vacuum cleaner.
Figure 2:
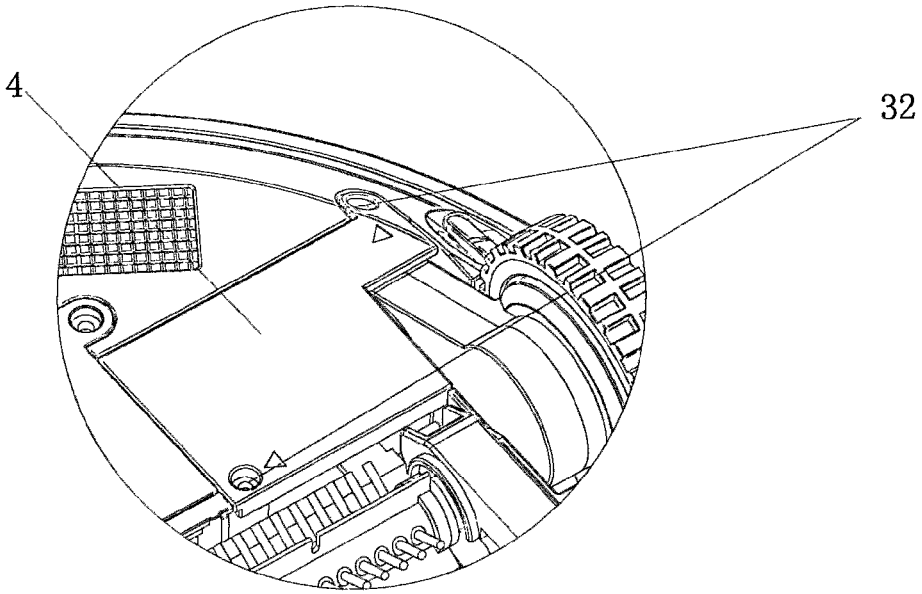
FIG. 2 PRIOR ART
FIG. 2 is a partially perspective view of the conventional intelligent vacuum cleaner.
Figure 3:
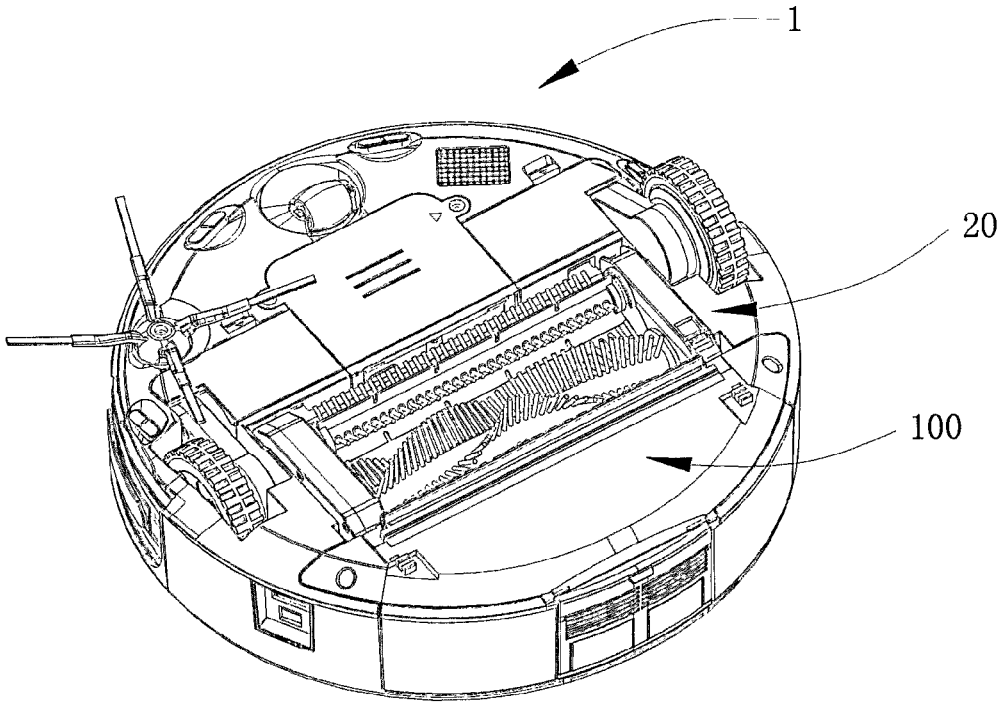
FIG. 3 is a first perspective view of an intelligent vacuum cleaner according to a preferred embodiment of the present invention.
Figure 4:
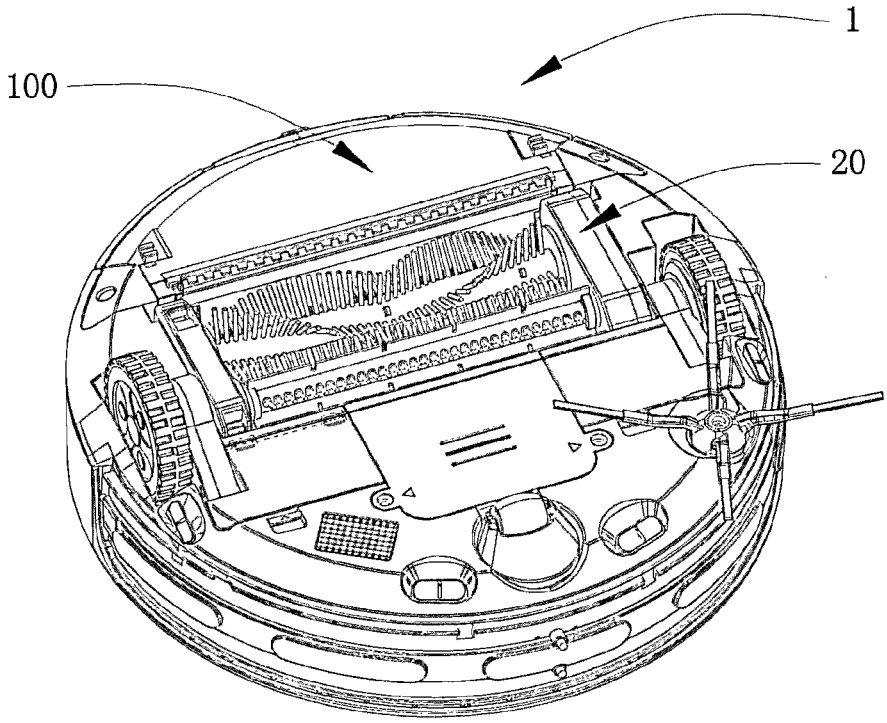
FIG. 4 is a second perspective view of the intelligent vacuum cleaner according to the above preferred embodiment of the preset invention.

Referring to FIG. 3 to FIG. 14 of the drawings, an intelligent vacuum cleaner according to a preferred embodiment of the present invention is illustrated, in which the intelligence vacuum cleaner comprises a main casing 1, a vacuum cleaning arrangement 20, and a plurality of detachable wheel assembly arrangements 2.

The main casing 1 has a plurality of wheel compartments 3 formed at a bottom side 100 of the main casing 1. The vacuum cleaning arrangement 20 is operatively provided in the main casing 1 for generating a predetermined vacuum effect.

Each of the detachable wheel assembly arrangement 2 is provided on the bottom side 100 of the main casing 1, and comprises at least one driving wheel 28 and a detachable mechanism 5 which is connected to the driving wheel 28 and is detachably mounted in the main casing 1 so that the diving wheel 2 and the detachable mechanism 5 are selectively detachable from the main casing 1 for convenient cleaning of the bottom side 100 of the main casing 1.

A power source, such as a rechargeable battery, can be electrically connected to the vacuum cleaning arrangement and the detachable wheel assembly arrangement 2 for providing power to drive the vacuum cleaning arrangement and the detachable wheel assembly arrangement 2 to operate.

Figure 5:
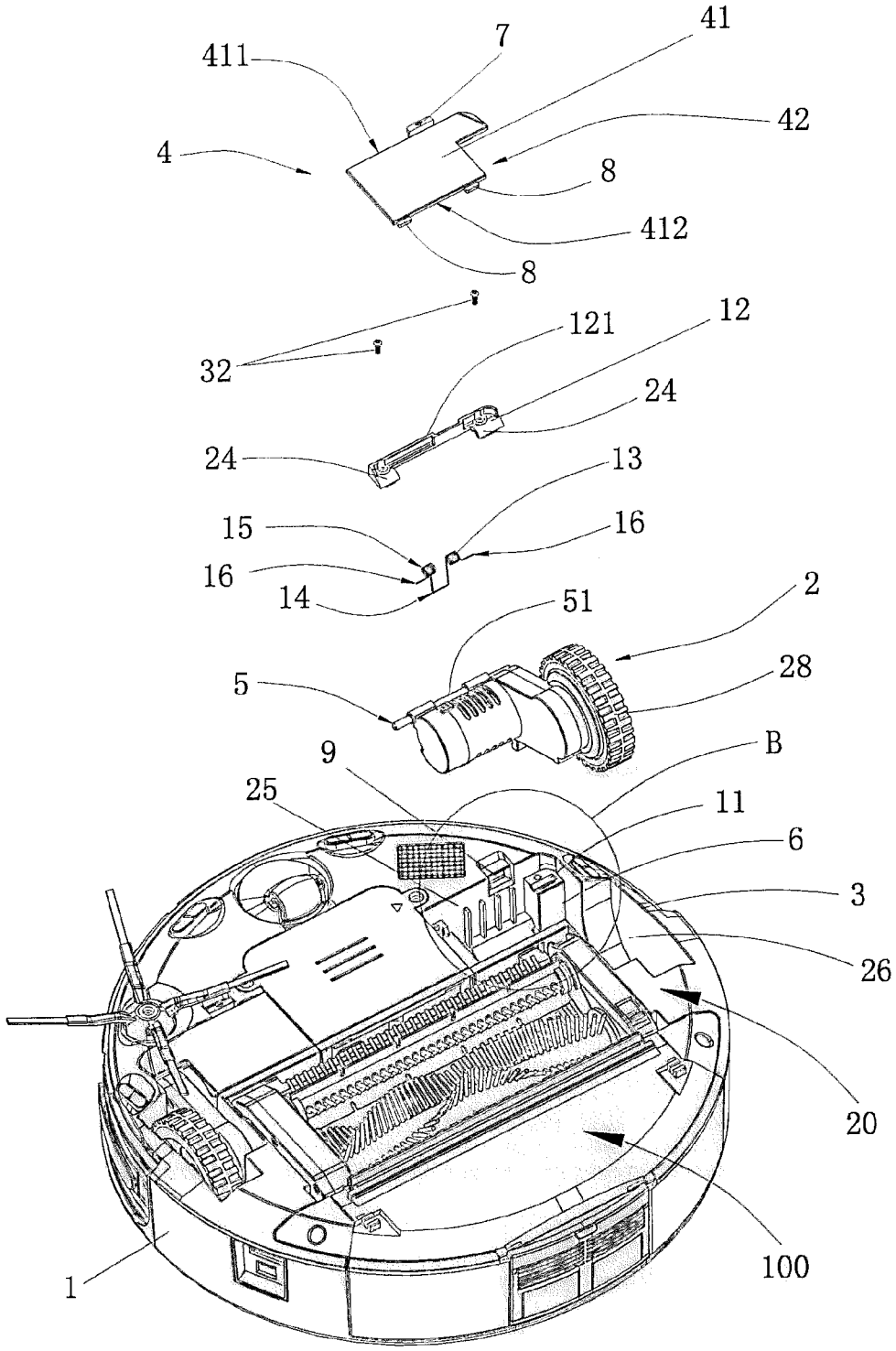
FIG. 5 is an exploded perspective view of the intelligent vacuum cleaner according to the above preferred embodiment of the present invention.

According to the preferred embodiment of the present invention, the main casing 1 is preferably circular in cross section, wherein each of the wheel compartments 3 has a L-shaped cross section, and is spacedly formed on the bottom side 100 of the main casing 1. As shown in FIG. 5 of the drawings, each of the wheel compartments 3 is divided into a motor cavity 25 and a wheel cavity 26 which is communicated with the motor cavity 25, wherein an longitudinal orientation of the motor cavity 25 and the wheel cavity 26 is substantially perpendicular so as to form a L-shaped cross section of the corresponding wheel compartment 3.

Moreover, the detachable wheel assembly arrangement 2 further comprises a rotating platform 6 which is provided in the motor cavity 25 and has a rotating slot 11 transversely formed on a top surface of the rotating platform 6, wherein the detachable mechanism 5 comprises a rotating shaft 51 arranged to be rotatably mounted in the rotating slot 11 of the rotating platform 6 when the driving wheel 28 is accommodated in the wheel cavity 26 of the corresponding wheel compartment 3. In order to mount the rotating shaft 51 on the rotating slot 11, the detachable wheel assembly arrangement 2 further comprises a securing member 12 mounted on top of the rotating platform 6 so as to sandwich the rotating shaft 51 between the securing member 12 and the rotating platform 6 in a rotatably movable manner.

Moreover, the securing member 12 comprises an elongated body 121 and a plurality of biasing members 24 formed at and transversely extended from two end portions of the elongated body 121. The biasing member 24 is secured, preferably through screws, onto the rotating platform 6.

The detachable mechanism 5 further comprises a resilient element 13 axially mounted on the rotating shaft 51 for ejecting the driving wheel 28 of the detachable wheel assembly arrangement 2. More specifically, the resilient element 13 has a plurality of coil spring portions 15 spacedly and axially mounted on the rotating shaft 51, a connecting portion 14 integrally and transversely extended between the coil spring portions 15, and a plurality of longitudinal portions 16 integrally, outwardly and longitudinally extended from outer ends of the coil spring portions 15 respectively.

The detachable wheel assembly arrangement 2 further comprises a plurality of wheel covers 4 detachably attached on the bottom side 100 of the main casing 1 for selectively and detachably covering the wheel compartments 3 respectively.

Each of the wheel covers 4 comprises a cover panel 41 and a detachable cover mechanism 42 provided on the cover panel 41 for detachably and selectively engaging with the bottom side 100 of the main casing 1. As shown in FIG. 5 of the drawings, the cover panel 41 is shaped and crafted to correspond with a shape of the corresponding wheel compartment 3 so that the cover panel 41 can fittedly cover the wheel compartment 3.

Figure 9:
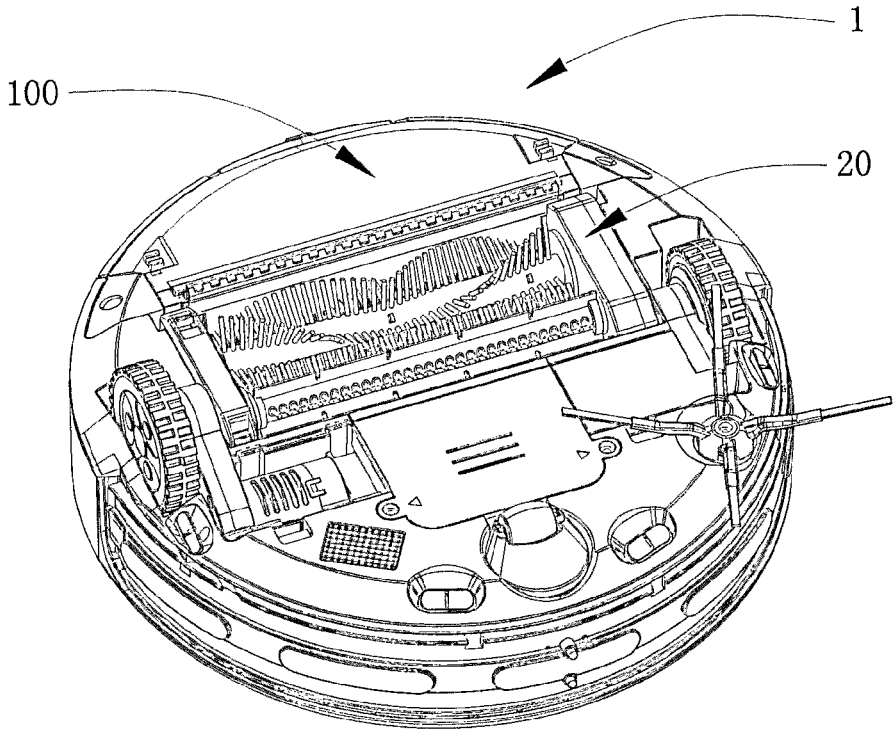
FIG. 9 is another perspective view of the intelligent vacuum cleaner according to the above preferred embodiment of the present invention, illustrating that the wheel cover is detached from the main casing.
Figure 10:
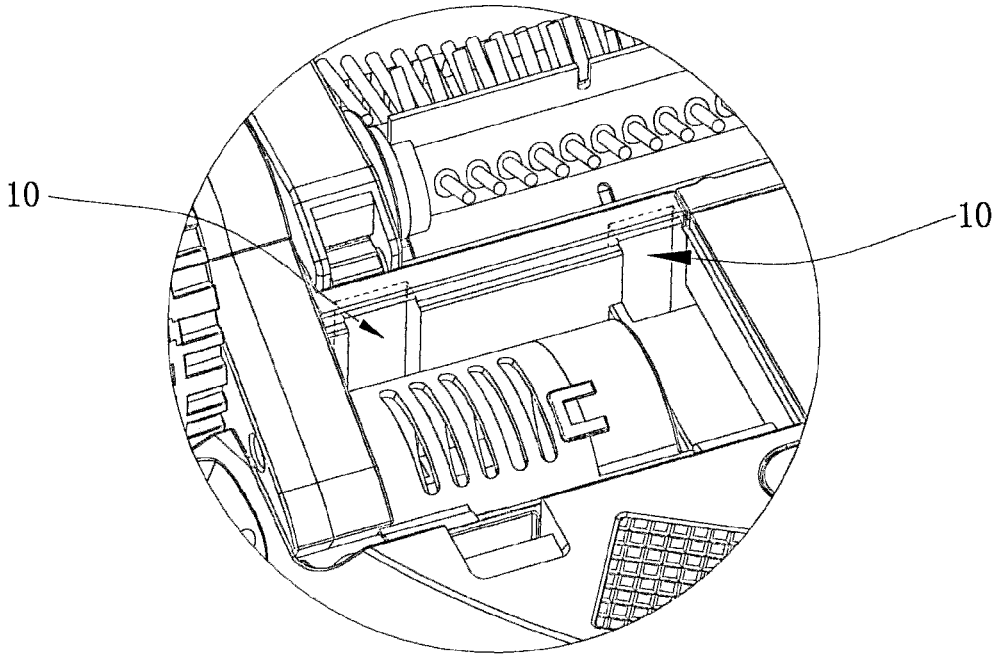
FIG. 10 is partially perspective view of the intelligent vacuum cleaner according to the above preferred embodiment of the present invention, illustrating that the wheel compartment on the main casing.

The detachable cover mechanism 42 comprises an elastic locking member 7 extended from a first peripheral edge 411 of the cover panel 41, a plurality of locking latches 8 extended from a second peripheral edge 412 which is opposite to the first peripheral edge 411, and contains a locking slot 9 formed on the bottom side 100 of the main casing 1 at a sidewall of the corresponding wheel compartment 3 and at a position aligning with the elastic locking member 7, and a plurality of engaging slots 10 spacedly formed on the bottom side 100 of the main casing 1 also at the sidewall of the corresponding wheel compartment 3, but aligning with the locking latches 8 respectively. Referring to FIG. 9 to FIG. 10 of the drawings, each of the wheel covers 4 is arranged to be detachably covered on the bottom side 100 of the main casing 1 in such a manner that the cover panel 41 is arranged to fittedly cover the corresponding wheel compartment 3 while the elastic locking member 7 is detachably engaged with the locking slot 9, and the locking latches 8 are detachably engaged with the engaging slots 10 respectively.

Figure 6:
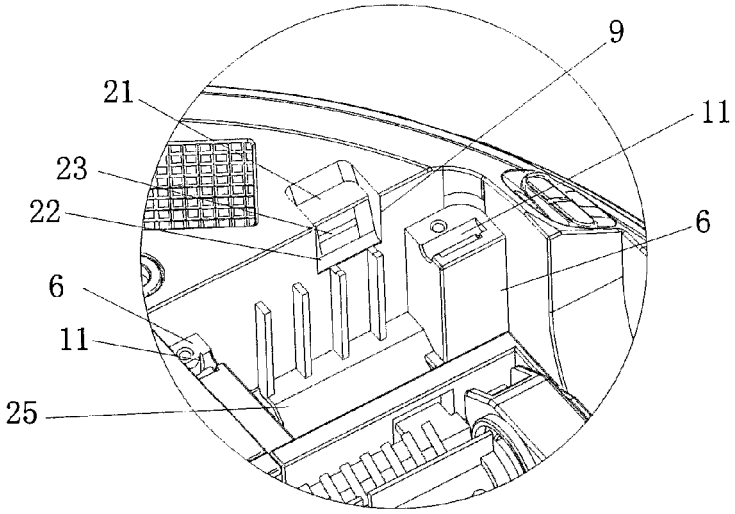
FIG. 6 is a partially exploded perspective view of the intelligent vacuum cleaner according to the above preferred embodiment of the present invention.

Referring to FIG. 6 of the drawings, the main casing 1 further has a plurality of locking sidewalls 22 formed on one of the sidewall of the motor cavity 25 respectively in the corresponding locking slots 9, and a plurality of locking indentions 23 formed on the locking sidewalls 22 respectively. Moreover, the main casing 1 further has a plurality of a supporting platforms 21 formed on the locking slots 9 respectively, wherein each of the supporting platforms 21 is extended between a corresponding sidewall of the locking slot 9 and the locking sidewalls 22.

Figure 7:
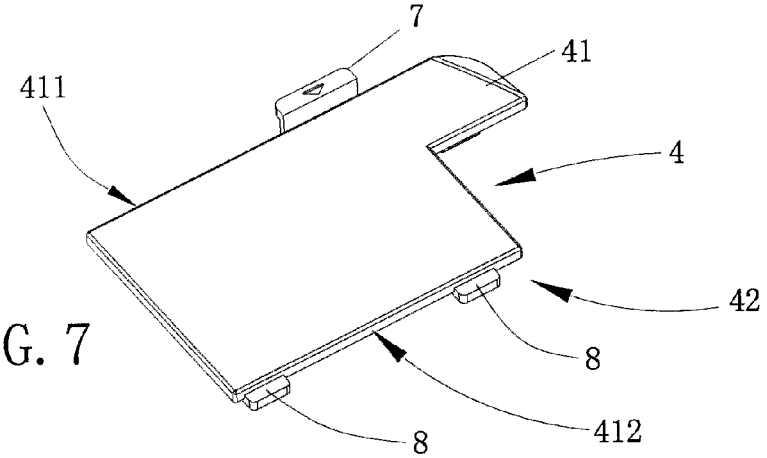
FIG. 7 is a top perspective view of a wheel cover of the intelligent vacuum cleaner according to the above preferred embodiment of the present invention.
Figure 8:
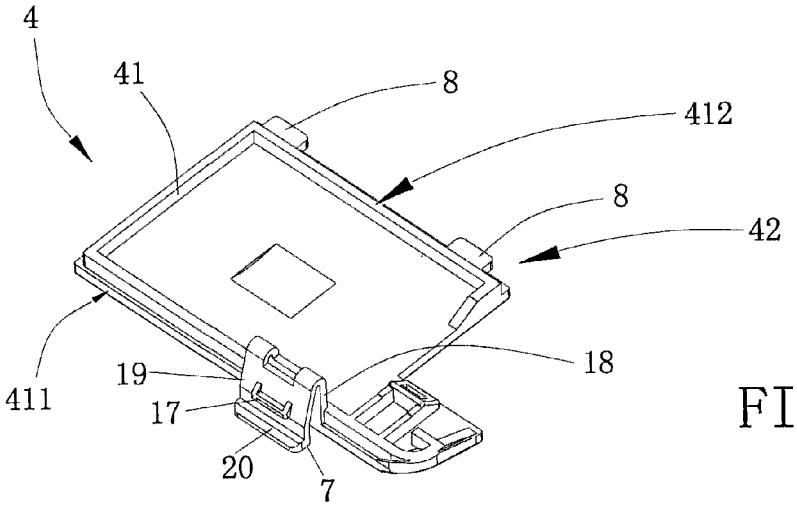
FIG. 8 is a bottom perspective view of a wheel cover of the intelligent vacuum cleaner according to the above preferred embodiment of the present invention.

Referring to FIG. 7 to FIG. 8 of the drawings, the elastic locking member 7 has a first locking leg 18 downwardly extended from the first peripheral edge 411 of the wheel cover 4, and a second locking leg 19 integrally upwardly extended from the first locking leg 18, wherein an intersection between the first locking leg 18 and the second locking leg 19 is curved so as to form a substantially U-shaped cross section of the elastic locking member 7. Furthermore, the elastic locking member 7 further has a protruding member 17 outwardly protruded from the second locking leg 19 and is arranged to align with the corresponding locking indention 23 formed on the main casing 1, wherein the protruding member 17 is arranged to fittedly receive in the locking indention 23 so as to selectively lock up a position of the wheel cover 4. Note that the first locking leg 18 and the second locking leg 19 has a predetermined elasticity so that the second locking leg 19 normally exerts an outward biasing force towards the main casing 1.

The elastic locking member 7 further has a pushing member 20 integrally extended from the second locking leg 19 for allowing a user to unlock the elastic locking member 7 by slightly pushing the pushing member 20 toward the main casing 1. When the elastic locking member 7 is locked on the main casing 1, the protruding member 17 is arranged to receive in the locking indention 23 while the second locking leg 19 is engaged with the corresponding locking sidewall 22. Since the second locking leg 19 has a predetermined elasticity, the elastic locking member 7 will keep locking with the locking indention 23 until a user of the present invention pushes the pushing member 20 to disengage the protruding member 17 from the locking indention 23.

Figure 11:
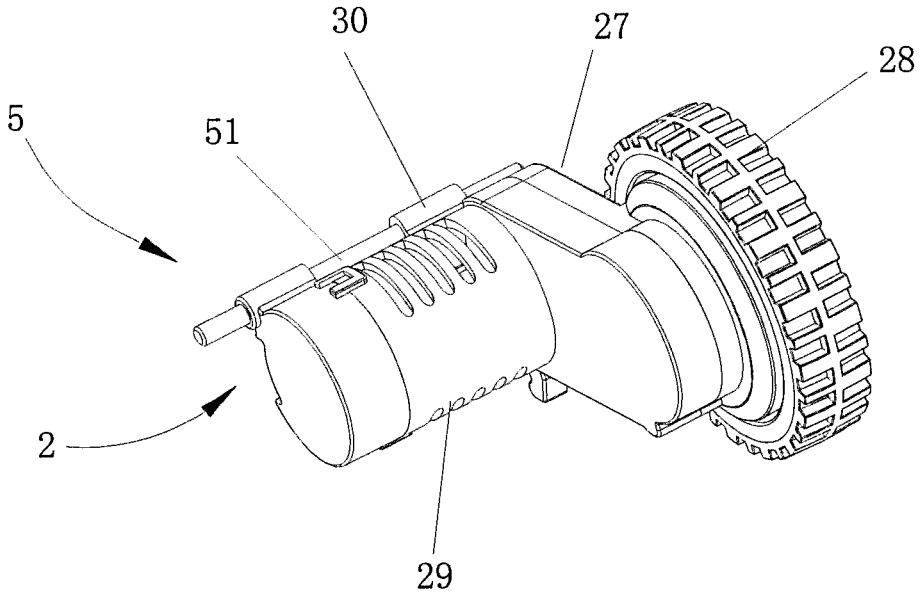
FIG. 11 is a perspective view of a detachable wheel assembly arrangement of the intelligent vacuum cleaner according to the above preferred embodiment of the present invention.

Referring to FIG. 11 of the drawings, each of the detachable wheel assembly arrangements 2 further comprises a driving motor 29, and a driving mechanism 27 rotatably extended between the driving motor 29 and the corresponding driving wheel 28 in such a manner that the driving motor 29 is arranged to drive the rotation of the driving wheel 28 through the driving mechanism 27.

The detachable wheel assembly arrangement 30 further comprises a plurality of tubular sleeves 30 axially mounted on the rotating shaft 51 of the detachable mechanism 5, wherein the driving motor 29 is accommodated in the motor cavity 25 of the corresponding wheel compartment 3. The driving mechanism 27 and the driving wheel 28 are accommodated in the wheel cavity 26 of the corresponding wheel compartment 3.

Figure 12:
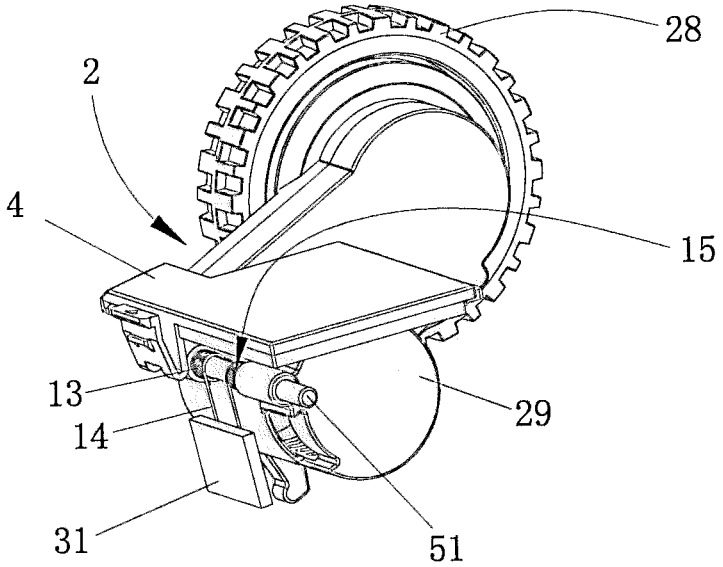
FIG. 12 a schematic diagram of the detachable wheel assembly arrangement according to the above preferred embodiment of the present invention.

Referring to FIG. 12 of the drawings, each of the wheel compartments 3 further has a side biasing wall 31 formed in the motor cavity 25, wherein the connecting portion 14 of the corresponding resilient element 13 is arranged to bias against the side biasing wall 31 of the motor cavity 25. When the wheel cover 4 is locked on the main casing 1, the wheel cover 4 is arranged to bias against the driving motor 29.

Figure 13:
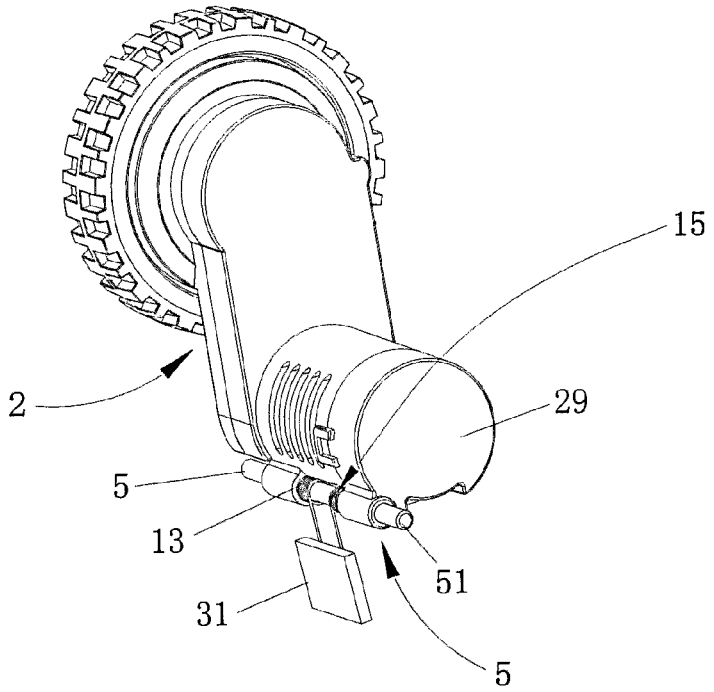
FIG. 13 is another schematic diagram of the detachable wheel assembly arrangement according to the above preferred embodiment of the present invention.
Figure 14:
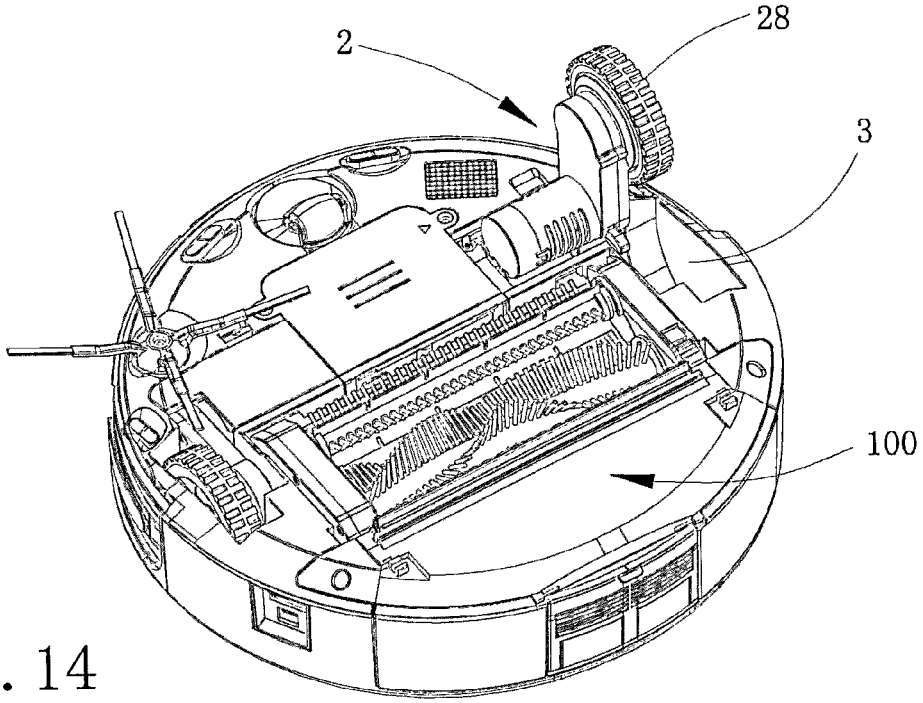
FIG. 14 is a schematic diagram of the intelligent vacuum cleaner according to the above preferred embodiment of the present invention.

Referring to FIG. 13 to FIG. 14 of the drawings, when the wheel cover 4 is opened, the resilient element 13 is arranged to exert a biasing force toward the driving mechanism 27 and the detachable wheel assembly arrangement 2 is forced to pivotally ejected from the wheel compartment 3 so as to allow the user to clean the driving wheel 28 or the wheel compartment 3.

The operation of the present invention is as follows: when the user wishes to detach the driving wheel 28 and the driving mechanism 27 from the main casing 1, he or she has to slightly push the elastic locking member 7 so as to unlock the wheel cover 4 and detach it from the main casing 1. Once the wheel cover 4 is removed from the main casing 1, the resilient element 13 is arranged to exert a biasing force for driving the driving mechanism 27 and the driving wheel 28 to rotate with respect to the driving motor 29. At this point, the user is able to detach the driving wheel 28 and the driving mechanism 27, and the driving motor 29 for cleaning the driving wheel 28 or the corresponding wheel compartment 3.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An intelligent vacuum cleaner, comprising:

a main casing having at least one wheel compartment formed at a bottom side of said main casing;

a vacuum cleaning arrangement operatively provided in said main casing for generating a predetermined vacuum effect; and at least one detachable wheel assembly arrangement which is provided on said bottom side of said main casing, and comprises at least one driving wheel and a detachable mechanism which is connected to said driving wheel and is detachably mounted in said main casing so that said diving wheel and said detachable mechanism are selectively detachable from said main casing for convenient cleaning of said bottom side of said main casing; wherein said wheel compartment is divided into a motor cavity and a wheel cavity which is communicated with said motor cavity, wherein said detachable wheel assembly arrangement further comprises a rotating platform which is provided in said motor cavity and has a rotating slot transversely formed on a top surface of said rotating platform, wherein said detachable mechanism comprises a rotating shaft arranged to be rotatably mounted in said rotating slot of said rotating platform when said driving wheel is accommodated in said wheel cavity of said corresponding wheel compartment.

2. The intelligent vacuum cleaner, as recited in claim 1, wherein said detachable wheel assembly arrangement further comprises a securing member mounted on top of said rotating platform so as to sandwich said rotating shaft between said securing member and said rotating platform in a rotatably movable manner.

3. The intelligent vacuum cleaner, as recited in claim 2, wherein said detachable mechanism further comprises a resilient element axially mounted on said rotating shaft for ejecting said driving wheel of said detachable wheel assembly arrangement, wherein said resilient element has a plurality of coil spring portions spacedly and axially mounted on said rotating shaft, a connecting portion integrally and transversely extended between said coil spring portions, and a plurality of longitudinal portions integrally, outwardly and longitudinally extended from outer ends of said coil spring portions respectively.

4. The intelligent vacuum cleaner, as recited in claim 3, wherein said detachable wheel assembly arrangement further comprises at least one wheel cover detachably attached on said bottom side of said main casing for selectively and detachably covering said wheel compartment respectively.

5. The intelligent vacuum cleaner, as recited in claim 4, wherein said wheel cover comprises a cover panel and a detachable cover mechanism provided on said cover panel for detachably and selectively engaging with said bottom side of said main casing.

6. The intelligent vacuum cleaner, as recited in claim 5, wherein said detachable cover mechanism comprises an elastic locking member extended from a first peripheral edge of said cover panel, a plurality of locking latches extended from a second peripheral edge which is opposite to said first peripheral edge, and contains a locking slot formed on said bottom side of said main casing at a sidewall of said corresponding wheel compartment and at a position aligning with said elastic locking member, and a plurality of engaging slots spacedly formed on said bottom side of said main casing also at said sidewall of said corresponding wheel compartment, but aligning with said locking latches respectively.

7. The intelligent vacuum cleaner, as recited in claim 6, wherein said main casing further has at least one locking sidewall formed as one of said sidewall of said motor cavity respectively in said corresponding locking slot, and a plurality of locking indentions formed on said locking sidewall respectively, wherein said main casing further has a supporting platform formed on said locking slot, wherein said supporting platform is extended between a corresponding sidewall of said locking slot and said locking sidewall.

8. The intelligent vacuum cleaner, as recited in claim 7, wherein said elastic locking member has a first locking leg downwardly extended from said first peripheral edge of said wheel cover, and a second locking leg integrally upwardly extended from said first locking leg, wherein an intersection between said first locking leg and said second locking leg is curved so as to form a substantially U-shaped cross section of said elastic locking member, wherein each of said first locking leg and said second locking leg to has a predetermined elasticity for normally exerting a biasing force in a predetermined direction.

9. The intelligent vacuum cleaner, as recited in claim 8, wherein said elastic locking member further has a protruding member outwardly protruded from said second locking leg and is arranged to align with said corresponding locking indention formed on said main casing, wherein said protruding member is arranged to fittedly receive in said locking indention so as to selectively lock up a position of said wheel cover.

10. The intelligent vacuum cleaner, as recited in claim 9, wherein said elastic locking member further has a pushing member integrally extended from said second locking leg for allowing a user to unlock said elastic locking member by slightly pushing said pushing member toward said main casing, wherein when said elastic locking member is locked on said main casing, said protruding member is arranged to receive in said locking indention while said second locking leg is engaged with said corresponding locking sidewall.

11. The intelligent vacuum cleaner, as recited in claim 10, wherein said detachable wheel assembly arrangement further comprises a driving motor, and a driving mechanism extended between said driving motor and said corresponding driving wheel in such a manner that said driving motor is arranged to drive said rotation of said driving wheel through said driving mechanism.

12. The intelligent vacuum cleaner, as recited in claim 11, wherein said detachable wheel assembly arrangement further comprises a plurality of tubular sleeves axially mounted on said rotating shaft of said detachable mechanism, wherein said driving motor is accommodated in said motor cavity of said corresponding wheel compartment, wherein said driving mechanism and said driving wheel are accommodated in said wheel cavity of said corresponding wheel compartment.

13. The intelligent vacuum cleaner, as recited in claim 12, wherein said wheel compartment further has a side biasing wall formed in said motor cavity, wherein said connecting portion of said corresponding resilient element is arranged to bias against said side biasing wall of said motor cavity, wherein when said wheel cover is locked on said main casing, said wheel cover is arranged to bias against said driving motor.

14. The intelligent vacuum cleaner, as recited in claim 13, wherein a longitudinal orientation of said motor cavity and said wheel cavity is substantially perpendicular to each other so as to form a L-shaped cross section of said corresponding wheel compartment.

15. The intelligent vacuum cleaner, as recited in claim 14, wherein said securing member comprises an elongated body and a plurality of biasing members formed at and transversely extended from two end portions of said elongated body.

16. The intelligent vacuum cleaner, as recited in claim 13, wherein said securing member comprises an elongated body and a plurality of biasing members formed at and transversely extended from two end portions of said elongated body.

17. The intelligent vacuum cleaner, as recited in claim 5, wherein a longitudinal orientation of said motor cavity and said wheel cavity is substantially perpendicular to each other so as to form a L-shaped cross section of said corresponding wheel compartment.

18. The intelligent vacuum cleaner, as recited in claim 5, wherein said securing member comprises an elongated body and a plurality of biasing members formed at and transversely extended from two end portions of said elongated body.

19. The intelligent vacuum cleaner, as recited in claim 3, wherein a longitudinal orientation of said motor cavity and said wheel cavity is substantially perpendicular to each other so as to form a L-shaped cross section of said corresponding wheel compartment.

* * * * *